US009707613B2

(12) United States Patent
Marti

(10) Patent No.: US 9,707,613 B2
(45) Date of Patent: Jul. 18, 2017

(54) DEVICE AND METHOD FOR SHAPING SHEARED EDGES ON STAMPED OR FINE-BLANKED PARTS HAVING A BURR

(71) Applicant: FEINTOOL International Holding AG, Lyss (CH)

(72) Inventor: Andreas Marti, Jegenstorf (CH)

(73) Assignee: Feintool International Holding Holding AG, Lyss (CH)

( * ) Notice: Subject to any disclaimer, the term of this patent is extended or adjusted under 35 U.S.C. 154(b) by 53 days.

(21) Appl. No.: 14/819,975

(22) Filed: Aug. 6, 2015

(65) Prior Publication Data

US 2016/0052039 A1 Feb. 25, 2016

(30) Foreign Application Priority Data

Aug. 20, 2014 (EP) ..... 14002887

(51) Int. Cl.
*B21D 28/16* (2006.01)
*B21D 19/00* (2006.01)
*B21D 28/26* (2006.01)

(52) U.S. Cl.
CPC ..... *B21D 28/16* (2013.01); *B21D 19/005* (2013.01); *B21D 28/26* (2013.01)

(58) Field of Classification Search
CPC ..... B21D 19/00; B21D 19/005; B21D 28/00; B21D 28/02; B21D 28/16; B21D 28/26; B21D 31/02
See application file for complete search history.

(56) References Cited

U.S. PATENT DOCUMENTS 3,478,558 A 11/1969 Hoffman et al.
5,492,001 A * 2/1996 Sasaki ..... B21D 19/005 72/327
2012/0006211 A1 1/2012 Bytow et al.

FOREIGN PATENT DOCUMENTS

| | | |
|---|---|---|
| CH | 665367 | 5/1988 |
| DE | 4113165 | 10/1991 |
| DE | 102004020483 | 11/2005 |
| DE | 102006018847 | 4/2010 |

* cited by examiner

*Primary Examiner* — Teresa M Ekiert
(74) *Attorney, Agent, or Firm* — Norris McLaughlin & Marcus, P.A.

(57) ABSTRACT

A device and a method for shaping sheared edges on stamped or fine-blanked parts having a burr include at least one cutting stage and at least one forming stage. The forming stage includes a shaping punch which has a shaping region for smoothing the sheared edge of the outer or inner contour of the workpiece to the net shape and an embossing shoulder for mashing the burr of the outer or inner contour. The shaping punch is configured so that the shaping region initially bends the burr on the outer or inner contour away from the sheared edge, then seizes the sheared edge for widening, wherein the embossing shoulder of the shaping punch mashes the burr on the outer or inner contour when the widening on the workpiece has ended and flattens the embossing bead, created during mashing, during separating of the shaping punch from the workpiece.

23 Claims, 15 Drawing Sheets

DEVICE AND METHOD FOR SHAPING SHEARED EDGES ON STAMPED OR FINE-BLANKED PARTS HAVING A BURR

BACKGROUND OF THE INVENTION

The invention relates to a device for shaping sheared edges on stamped or fine-blanked workpieces such as bobs, disks, synchronizer rings for clutches or the like, having a burr, comprising an upper part and a lower part, which form at least one cutting stage for cutting the outer and/or inner contours of the workpiece, and at least one forming stage for mashing the burrs created during cutting, wherein the forming stage is divided into a fixed upper die part having an embossing be and a lower the part movable in the stroke direction having an embossing anvil.

The invention further relates to a method for shaping sheared edges of stamped or fine blanked-workpieces such as bobs, disks, synchronizer rings or the like, having a burr, in which the outer contour and/or inner contour of a workpiece are cut from a flat strip within a device comprising an upper part and a lower part in a stamping or fine blanking stage, the cut workpiece is transferred into a forming stage by a cross slide (16) after the device has been opened, and the net shape of the workpiece is created in this forming stage.

Stamped and fine-blanked parts are known to have a burr on the side of the sheared edge opposite the punch side, the size of the burr being dependent on various influencing factors, such as the die clearance between the punch and the die plate, the strength of the material, and the wear of the punch and cutting plate (see DIN 6930 and VDI Guideline 2906). This burr is undesirable since it limits the functional capability of high-precision parts. The burr must be removed by way of reworking, which necessitates additional complex work steps, such as grinding and brushing, for example, recutting (CH 665 367 A5) or mashing the burr edges (DE 41 13 165 A1, U.S. Pat. No. 3,478,558 A, DE 10 2004 020 483 A1, DE 10 2006 018 847 34).

The sheared edges of stamped parts additionally exhibit a variably large fracture surface, which considerably reduces the functional area, which is to say the flush-cut surface, so that in addition to removing the burr, it is also necessary to rework the entire sheared edge, losing material, so as to ensure a final contour of the part that is true to shape.

In particular in the case of parts having non-circular inner contours, such as kidney-shaped or elliptic openings, apertures or holes in the workpiece, reworking is particularly complex, since the subsequent mashing of the burr edges by way of roller bodies (DE 41 13 165, DE 10 2004 020 483 A1) is not suitable here, and only grinding and brushing of the cut edges will ensure the necessary precision.

Subsequent mashing of the burr has the added disadvantage that an embossing bead is formed, which detracts from the accuracy of the sheared edge.

SUMMARY OF THE INVENTION

With this prior art in mind, it is the object of the invention to create a device and a method for shaping sheared edges on stamped or fine-blanked parts such as bobs, disks, synchronizer rings or the like, having a burr, which make it possible to achieve a high-precision inner contour and outer contour on stamped or fine-blanked parts in a way that is true to shape and dimensions, while also eliminating reworking and saving material and costs.

The core idea of the solution according to the invention is to first bring the entire sheared edge of an outer contour or inner contour on a stamped or fine-blanked part, such as of an elliptic hole, having a burr into such a position that the burr can be bent away from the cut edge on the workpiece, then widen the sheared edges on the inner contour in a defined manner to the net shape and dimensions using a shaping punch, and subsequently completely flatten the embossing bead created during mashing, within one stage.

This is achieved in that the forming stage comprises a shaping punch, which has a shaping region for smoothing the sheared edge of the outer or inner contour to the net shape and an embossing shoulder for mashing the burr of the outer or inner contour, the embossing shoulder being designed so that the shaping region initially bends the burr on the outer or inner contour away from the sheared edge, then seizes the sheared edge for widening, wherein the embossing shoulder of the shaping punch mashes the burr on the outer or inner contour when the widening on the workpiece has ended, forming an embossing bead, and flattens the embossing bead during demolding of the shaping punch.

It is particularly advantageous that the shaping punch has shapes and dimensions that are adapted to the outer contour or inner contour of the workpiece, for example circular or non-circular openings, such as holes, boreholes, or cut-outs. This makes it possible to use the device according to the invention for the production of stamped or fine-blanked parts having different configurations, such as bobs, disks, synchronizer rings, or the like.

According to a preferred embodiment variant of the device according to the invention, the shaping region of the shaping punch is formed of a spherical segment-shaped thickening that is provided at the head end of the punch and is oversized in a defined manner in relation to the outer or inner contour so as to radially widen the sheared edge and flatten the embossing bead. During the stroke movement of the workpiece, the thickening of the shaping region engages the sheared edge and displaces the material radially into the workplace, so that an evenly smooth surface is imparted to the sheared edge of the inner contour, which can be brought into the desired net shape and dimensions. During demolding of the shaping punch, which is to say during the return movement of the shaping punch counter to the stroke direction, the shaping region moves past the embossing bead, flattening the same.

In a further embodiment of the device according to the invention, the shape and dimensions of the shaping punch are adapted to the inner contour of the workpiece, for example circular or non-circular openings such as holes, boreholes or cut-outs. This makes it possible to use the device according to the invention for the production of stamped or fine-blanked parts having different configurations, such as bobs, disks, synchronizer rings, or the like.

In a refinement of the invention, the embossing shoulder is provided on the shaping punch at a height on the head end of the shaping punch at which, during the vertical movement of the workplace, the shaping region of the shaping punch first slightly bends the burr present on the outer or inner contour away from the sheared edge, then seizes the sheared edge of the outer or inner contour for widening, and flattens the embossing bead during the return stroke of the shaping punch.

In a further embodiment of the device according to the invention, the shaping punch is fixed on an upper block of the upper part in a stationary manner.

In a further advantageous embodiment of the device according to the invention, the embossing bell is provided with an embossing shoulder, wherein an ejector that is designed to be movable in the stroke direction is provided in the embossing bell for vertically guiding the shaping punch.

So as to fix the outer contour of the workplace, the embossing bell has an annular design and completely surrounds the outer contour of the workplace.

The spring-loaded holder for the embossing anvil is vertically guided in an embossing positioning plate held by a cavity frame and has a support surface, which forms a seat for the embossing bell when the upper die part and the lower die part are closed.

The cavity frame is fixed on the lower block in the stationary manner, in which the lower additional hydraulic unit is accommodated, which via a lower embossing pressure plate that is additionally supported by a spring force is operatively connected to the embossing anvil by lower pressure pins.

A further preferred embodiment of the device according to the invention provides for the upper additional hydraulic unit accommodated in an upper block to be operatively connected to the ejector via an upper embossing pressure plate, and for the shaping punch to be attached in a fixed position on the upper embossing pressure plate, wherein the ejector is operatively connected to the upper additional hydraulic unit via pressure pins that are subject to additional spring force for detaching the finished workpiece.

The object is further achieved by a method in which the following steps are carried out in a single operation in the forming stage:

a) slightly bending the burr present on the sheared edge of the outer or inner contour away from the sheared edge by way of a shaping punch having a shaping region, when the workpiece carries out a vertical movement in the stroke direction;
b) widening the sheared edge of the outer or inner contour of the workpiece, by way of the shaping region of the shaping punch, to the desired net shape and dimensions until the embossing shoulder on the shaping punch seizes the burr on the sheared edge of the outer or inner contour;
c) creating an embossing bead in the sheared edge by mashing the burr of the outer or inner contour on the workpiece by way of the embossing shoulder of the shaping punch;
d) flattening the embossing bead by way of the shaping region of the shaping punch during demolding thereof from the workpiece, by way of a vertical movement of the shaping punch counter to the stroke direction of the workpiece.

It is particularly advantageous for the widening of the sheared edge to the desired net shape and dimensions to begin on the side of the sheared edge facing the burr and to end on the burr-less sheared edge, without the orientation of the slightly bent burr changing during the widening step.

In a further embodiment of the method according to the invention, shaping punches having different shapes and dimensions may be used. The only prerequisite is that the shaping punch is adapted to the inner contour of the workpiece, for example to circular or non-circular openings, such as holes, boreholes or cut-outs, with a defined oversized dimension. This makes it possible to use the method according to the invention for stamped or fine-blanked parts having different configurations, such as centrifugal weights, disks, synchronizer ring, or the like.

A further advantageous embodiment of the method according to the invention provides for the burr of the outer contour to be mashed, simultaneously with the burr of the inner contour, by an embossing shoulder of the embossing bell, wherein the outer contour of the workpiece is fixed by the embossing be forming part of the upper the part, and the workpiece is deposited on the embossing anvil of the lower the part in an appropriately positioned manner.

Further advantages, features and details of the invention will be apparent from the following description with reference to the accompanying drawings.

The invention shall be described in more detail hereafter based on the example of producing a bob having elliptic holes as the inner contour. It goes without saying that the invention also covers stamped or fine-blanked parts having different shapes at the outer and inner contours, such as disks.

DETAILED DESCRIPTION OF THE INVENTION

Figure 1A:
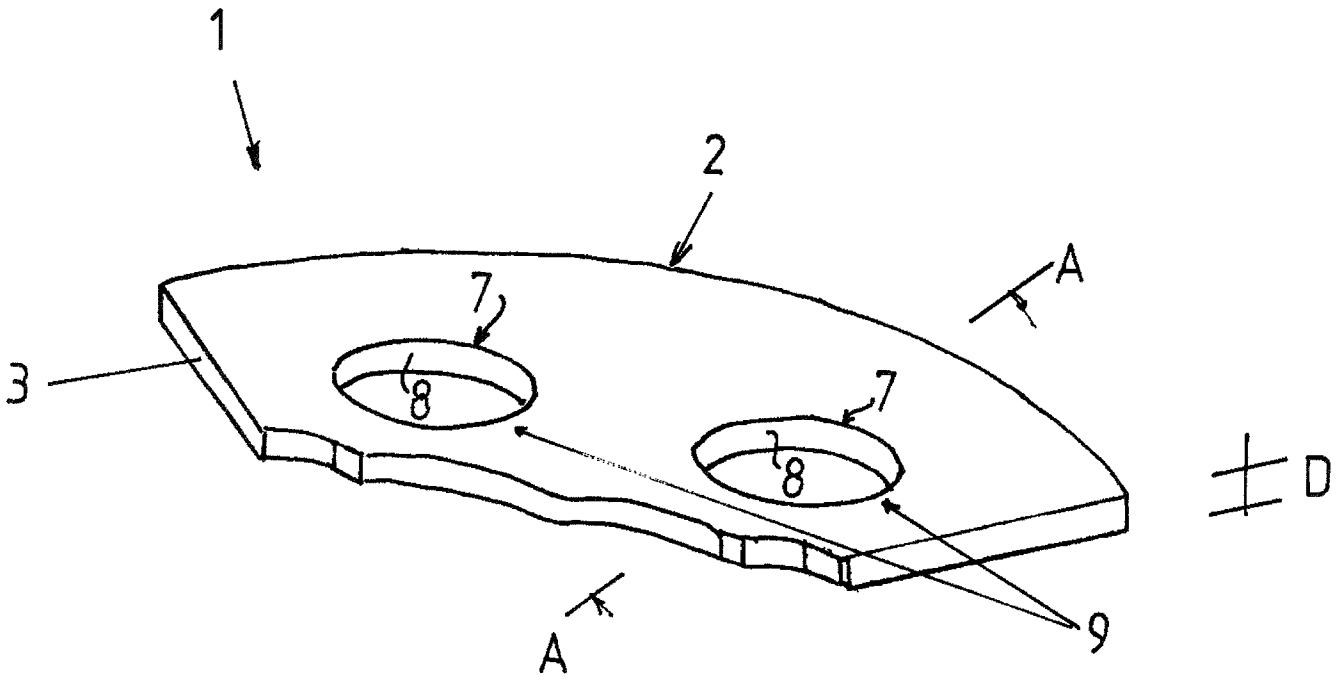
FIGS. 1*a* and 1*b* show a perspective view and a section along line A-A of FIG. 1*a* of a fine-blanked workpiece for a commercially available centrifugal weight.
Figure 1B:
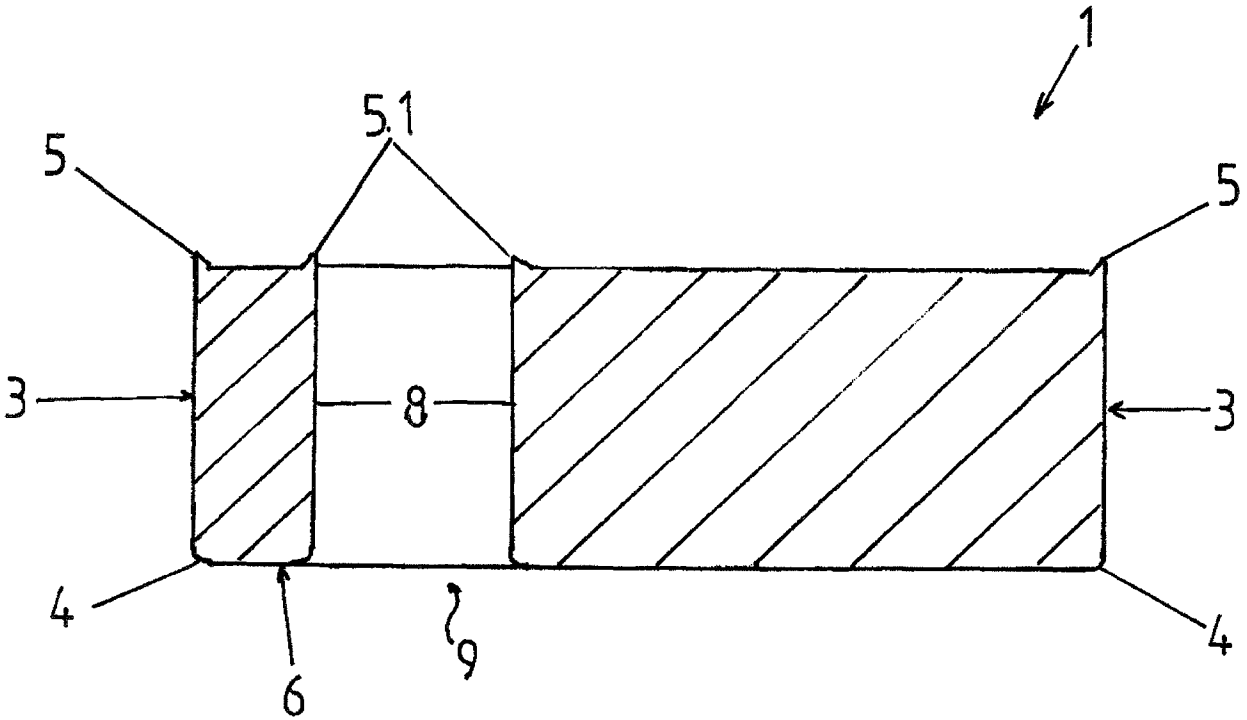

FIGS. 1*a* and 1*b* show a workplace 1 for a bob, for example, which was produced by way of fine blanking. On the outer contour 2, it has sheared edges 3 having rollover 4 and a burr 5, wherein the burr 5 is located on the side 6 of the workplace 1 facing away from the rollover. The inner contour 7 is formed by the sheared edges 8, which are part of two ellipsoidal holes 9. The sheared edges 8 likewise have a corresponding burr 5.1. The workpiece 1 has a thickness D of 6 mm, for example, and is made of steel.

Figure 2:
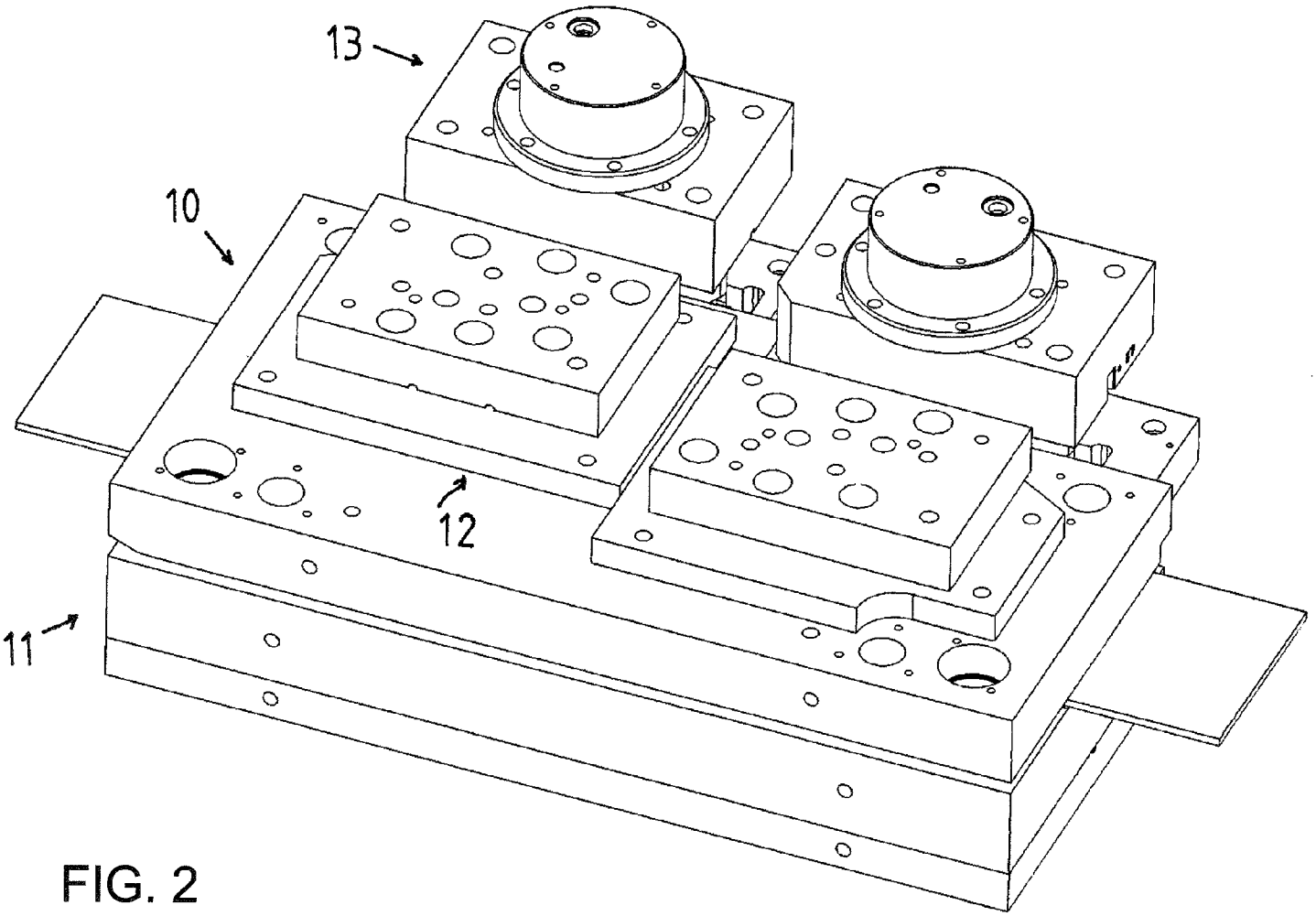
FIG. 2 shows a perspective top view onto an exemplary arrangement of a fine blanking stage and a forming stage in a device according to the invention.

The workplace 1 is to be produced in a device that comprises an upper part 10 and a lower part 11 and—as shown in FIG. 2—is composed of at least one fine blanking stage 12 and at least one forming stage 13.

The upper block 14 (FIG. 3*a*) of the upper part 10 is fixed in a stationary manner on a machine table, which is not shown, and the lower block 15 of the lower part 11 is fixed on a ram of a press so as to be able to perform stroke movements, so that the workpiece 1 is fine-blanked from bottom to top—which is to say in the direction of the upper part—from a flat strip in the fine blanking stage 12, which corresponds to the known prior art and therefore need not be described in more detail.

The burr 5 of the sheared edge 3 of the outer contour 2 projects perpendicularly downward, while the burr 5.1 of the sheared edge 8 of the inner contour 7 projects perpendicularly upward from the workplace 1 (see also FIG. 1*b*).

After having been ejected from the fine blanking stage 12, the fine-blanked workpiece 1 is seized by a cross elide 16 and transported by the same into the forming stage 13, where the workpiece is deposited in an accurately positioned manner prior to the forming step (see also FIGS. 3*a* to 3*f*).

FIGS. 3*a* to 3*f* show the basic design of the forming stage 13 in a variety of processing states. The forming stage 13 comprises an upper die part 17 and a lower die part 18.

The upper die part 17 includes an annular embossing bell 19, an ejector 20, and shaping punch 21. The embossing bell 19 is fixed to an upper embossing block 22*a* in a stationary manner, the embossing block 22*a* in turn being fixed to the upper block 14.

The ejector 20 is supported vertically on the inner wall of the embossing bell 19 and horizontally on the upper embossing pressure plate 22, such that the ejector 20 is able to carry out a vertical relative movement with respect to the embossing bell 19.

The operative connection between the ejector 20 and the upper embossing pressure plate 22 is established by pressure pins 25 that are additionally subject to spring force.

The shaping punch 21 is inserted into the ejector 20, the punch in turn being held on the upper embossing block 22*a* in a stationary manner.

The embossing pressure plate 22 is accommodated in the upper embossing block 22*a* and is operatively connected to an upper additional hydraulic unit 23 and a pressure pin 24. The ejector 20 is vertically guided and supported on the outer wall of the embossing bell 19 on one side and on the shaping punch 21 on the other side.

The lower die part 18 is formed by a cavity frame 26, a holder 27, and an embossing anvil 8. The cavity frame 26 is attached to the lower block 15. The embossing anvil 28 is seated on a lower embossing pressure plate 29, which in turn is operatively connected via a lower additional hydraulic unit 30. The operative connection between the embossing pressure plate 29 and the lower additional hydraulic unit 30 is ensured by lower pressure pins 32. In addition, the lower embossing pressure plate 29 is held with the lower black 15 via a pin 38 that is placed under spring action by a compression spring 44.

The holder 27, which contains the embossing anvil 28, is held in a spring-loaded manner on an intermediate plate 42 by way of a compression spring 31 guided by a pin 43, so that the holder 27 is able to carry out a vertically directed relative movement with respect to the embossing anvil 28 and the embossing positioning plate 29.

The holder 27 moreover has a support surface 46, which forms a seat for the embossing bell 19 when the upper die part 17 and the lower die part 18 are closed.

Figure 3B:
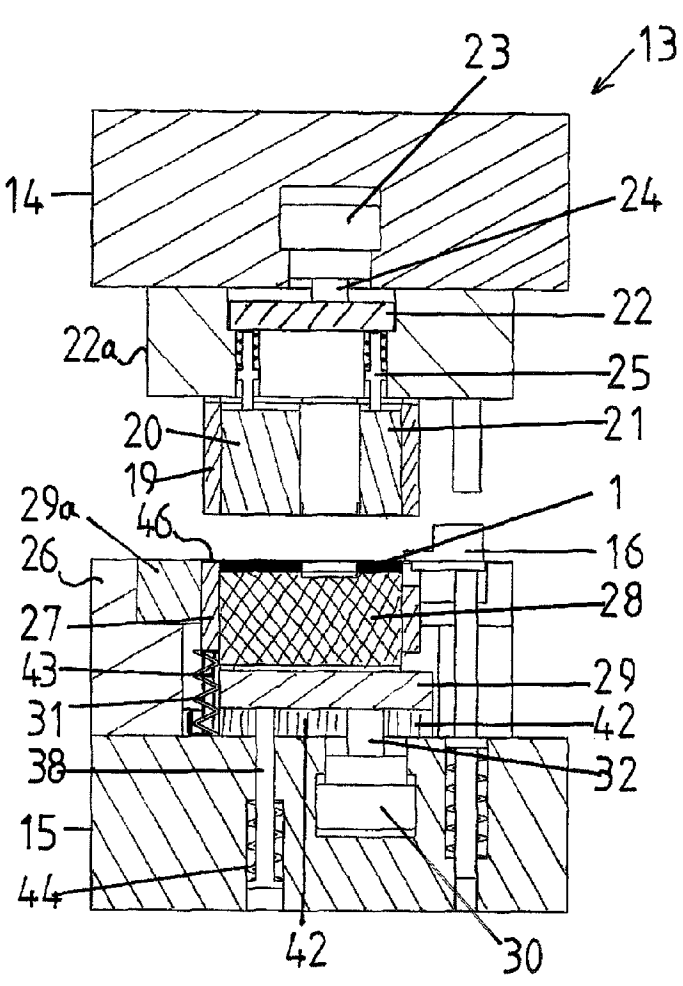
FIG. 3*b* shows a schematic sectional illustration of the forming stage with a returned embossing anvil.
Figure 3A:
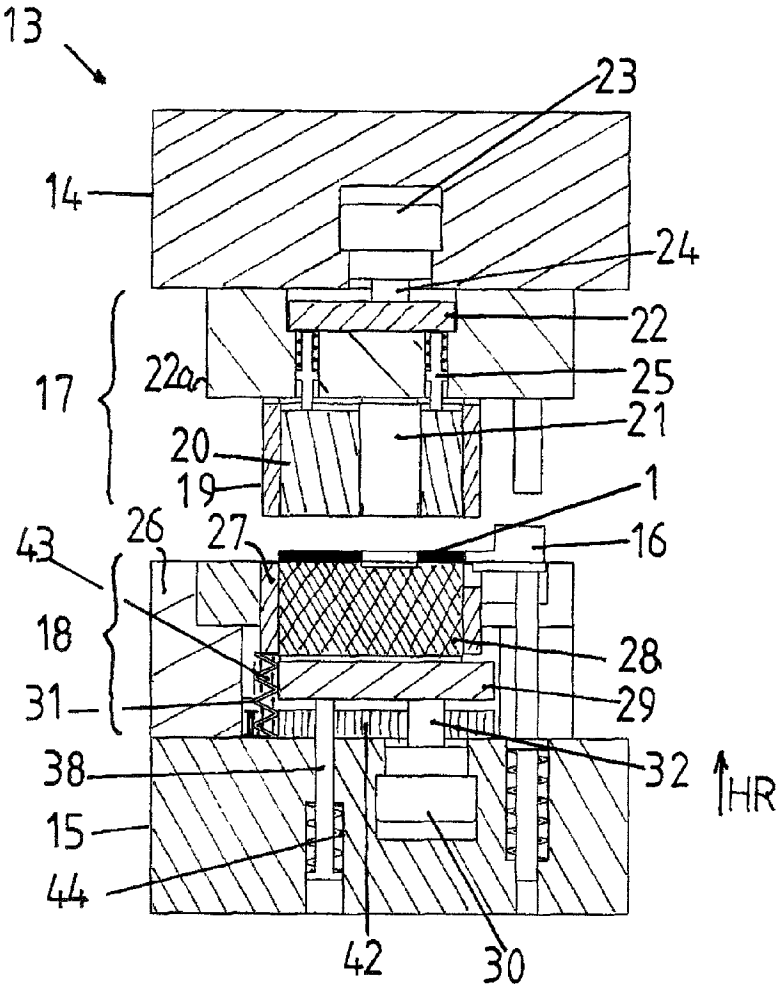
FIG. 3*a* shows a schematic sectional illustration of the forming stage in the open state.

FIG. 3*b* shows the state of the embossing stage 13 when the embossing anvil 28 has returned. For this purpose, the lower additional hydraulic unit 30 decreases the load on the lower pressure pin 32, so that the embossing anvil 28 travels back with respect to the holder 27 in the direction of TDC so far that the fine-blanked workpiece 1 is seated in the holder 127 in an appropriately positioned manner.

Figure 3D:
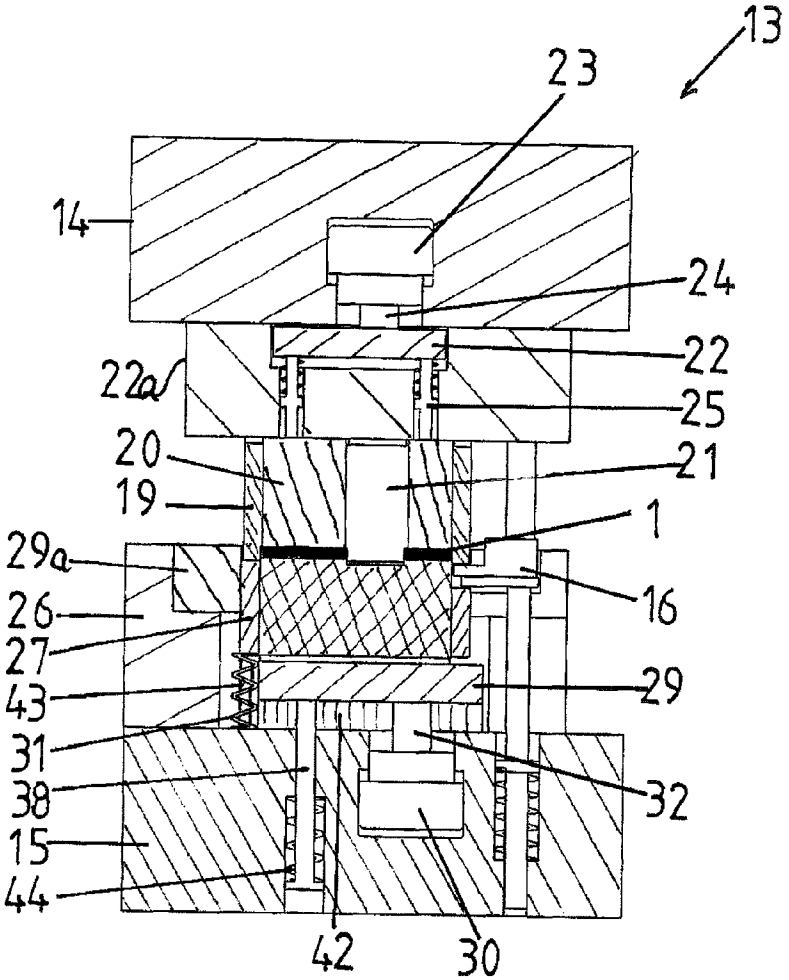
FIG. 3*d* shows a schematic sectional illustration of the forming stage in the state after mashing of the burr.
Figure 3C:
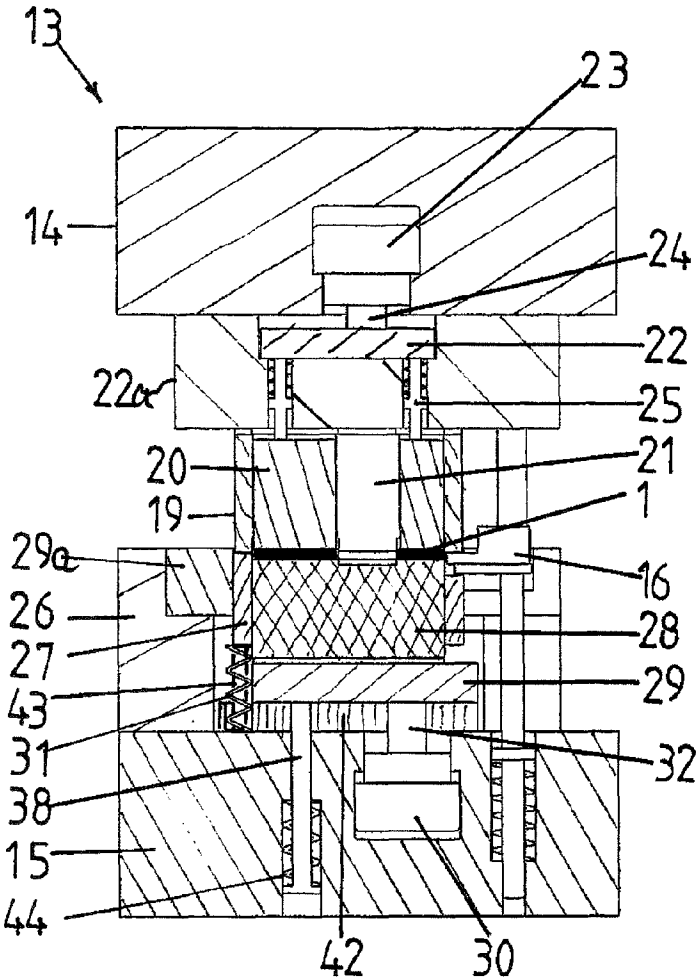
FIG. 3*c* shows a schematic sectional illustration of the forming stage in the clamped state.

FIG. 3*c* shows the workpiece 1 when clamped between the ejector 20 and the embossing anvil 28, which is the prerequisite for starting the shaping process by way of the shaping punch 21.

FIG. 3*d* shows the state after the burr mashing has been completed.

Figure 3F:
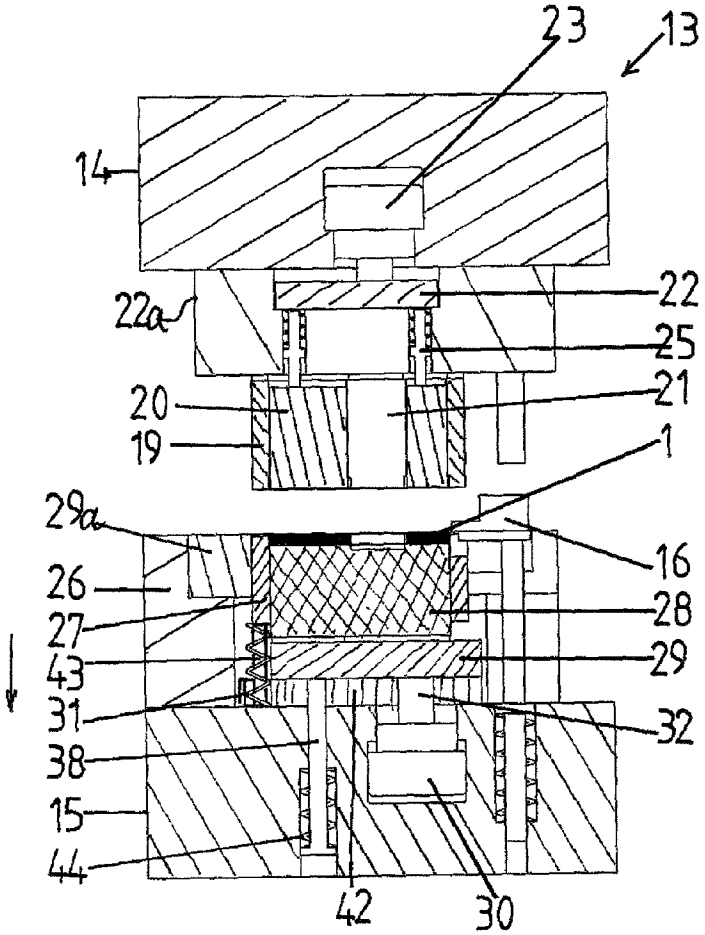
FIG. 3*f* shows a schematic sectional illustration of the forming stage during opening.
Figure 3E:
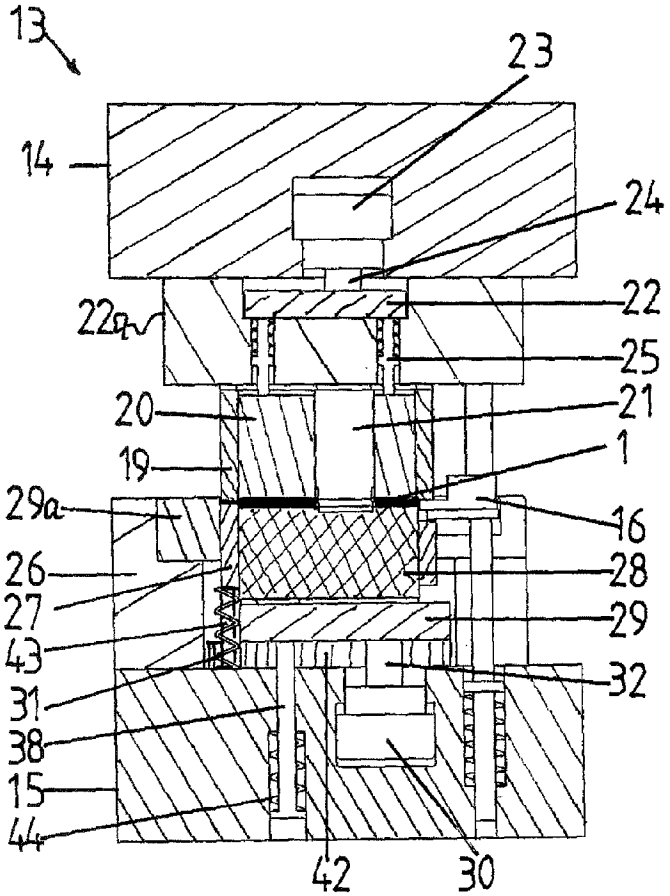
FIG. 3*e* shows a schematic sectional illustration of the forming stage with a workplace partially detached from the shaping punch.

In FIG. 3*e*, the upper additional hydraulic unit 24 has moved the shaping punch 21 back in the direction of bottom dead center with respect to the workpiece 1 on which the burr has been mashed. The workpiece 1 on which the burr has been mashed is partially detached, but not yet ejected.

FIG. 3*f* shows the state in which the forming stage is open, before the cross slide 16 is moved in so as to discharge the workpiece 1.

Figure 4:
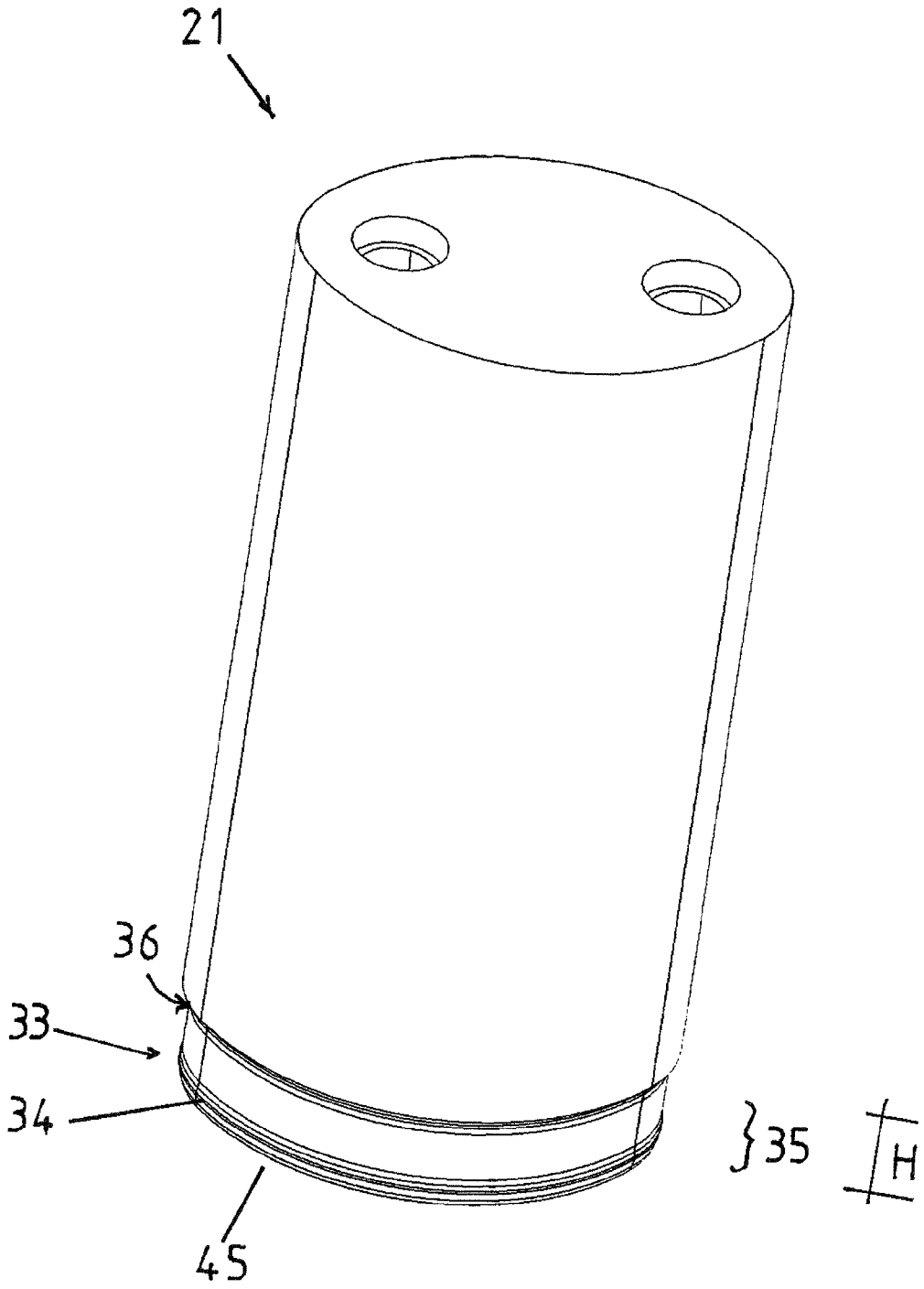
FIG. 4 shows an enlarged illustration of the shaping punch comprising an embossing shoulder and a shaping region provided at the head.

As is shown in an enlarged illustration in FIG. 4, the shaping punch 21 is appropriately adapted to the inner contour 7 of the workpiece 1, which is to say it has an ellipsoidal shape like the hole 9. The head 33 of the shaping punch 21 is shaped as a spherical segment-shaped thickening 34, which has defined slightly oversized dimensions compared to the inner contour 7 (holes 9). This thickening 34 on the shaping punch 21 forms a shaping region 35. As soon as the workpiece 1 clamped between the ejector 20 and the embossing anvil 28 moves from the bottom to the top during the stroke, the shaping region 35 first presses the burr 5.1 on the inner contour outward in the direction of the burr 5 on the outer contour 2 and then engages the sheared edges 8 of the inner contour 7, so that the inner contour 7 is widened along the circumference thereof by a defined degree by material displacement into the workplace interior, and the desired shape and dimensions are imparted to the inner contour 7 (see also FIGS. 9*a* to 9*f*).

The shaping punch 21 moreover has an embossing shoulder 36, which is provided at a height H such that this is spaced vertically from the head end 45 of the shaping punch 21, which is slightly greater than the thickness D of the workpiece 1.

Once the sheared edge 8 has moved past the shaping region 35 during the stroke of the workpiece 1, the inner contour 7 (hole 9) is widened by a defined degree and smoothed. The embossing shoulder 36 of the shaping punch 21 has seized the burr 5.1 on the inner contour and mashed it into the upper face of the workpiece 1, whereby an embossing bead 47 is created on the sheared edge 8.

Figure 5:
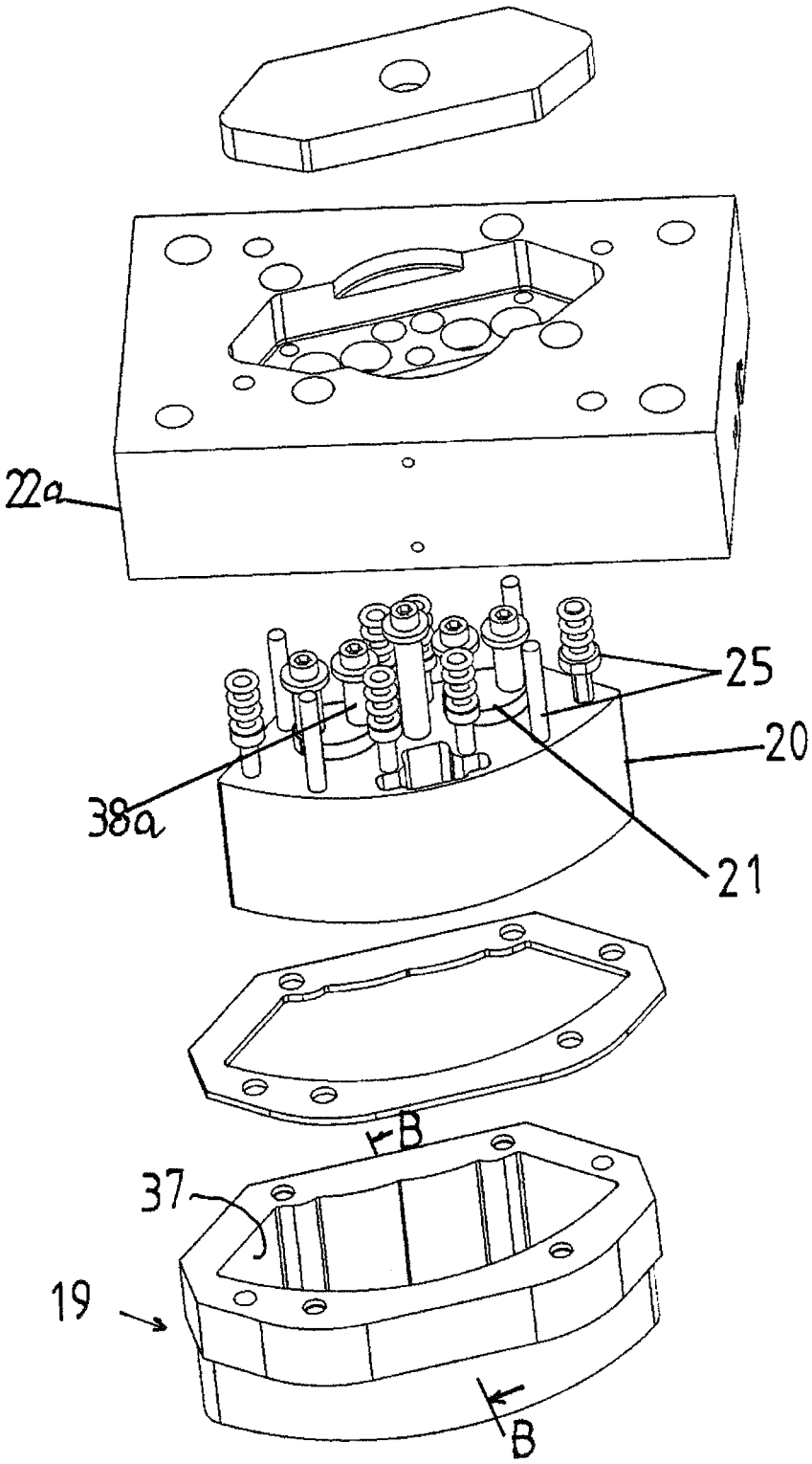
FIG. 5 shows a perspective view of the upper die part of the device according to the invention in a depiction of revolution.
Figure 6:
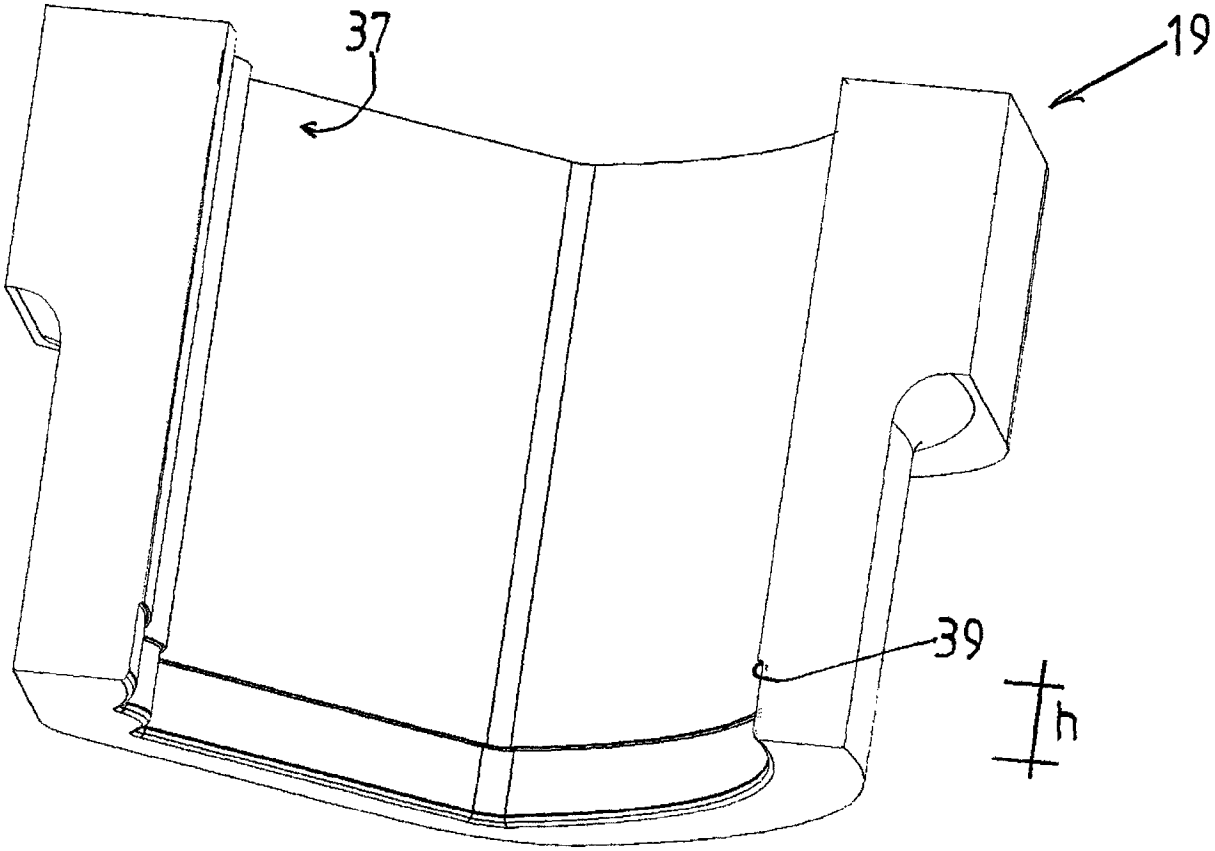
FIG. 6 shows an enlarged illustration of the embossing bell comprising the embossing shoulder.

FIGS. 5 and 6 show the design of the upper die part 17.

The ejector 20, which is vertically guided on the inner wall 37 of the embossing bell 19 and acted upon by the pressure pins 25 so as to carry out a relative movement with respect to the fixed embossing bell 19, is inserted into the embossing bell 19 (see FIG. 5).

The shape of the embossing bell 19 is adapted to the outer contour 2 of the workplace 1, whereby the circumference of the outer contour 2 can be completely surrounded by the inner wall 37 of the embossing bell 19.

The shaping punches 21 are attached to the upper embossing pressure plate 22 by screw bolts 38*a* and vertically guided in the ejector 20, so that the shaping punches 21 are fixed on the upper embossing block 22*a* in a stationary manner.

FIG. 6 shows a section of the embossing bell 19 along line B-B in FIG. 5. An embossing shoulder 39 is provided on the inner wall 37 of the embossing bell 19 along the circumference thereof. This embossing shoulder 39 is designed so as to be able to mash the upwardly projecting burr 5 on the outer contour 2 as soon as the workpiece 1 seizes the upwardly projecting burr 5.1 during the stroke movement. The embossing shoulder 39 is provided at a height h that corresponds to the height H of the shaping punches 21. This ensures that the mashing on the inner contour 7 and the outer contour 8 takes place simultaneously on the workpiece 1.

Figure 7:
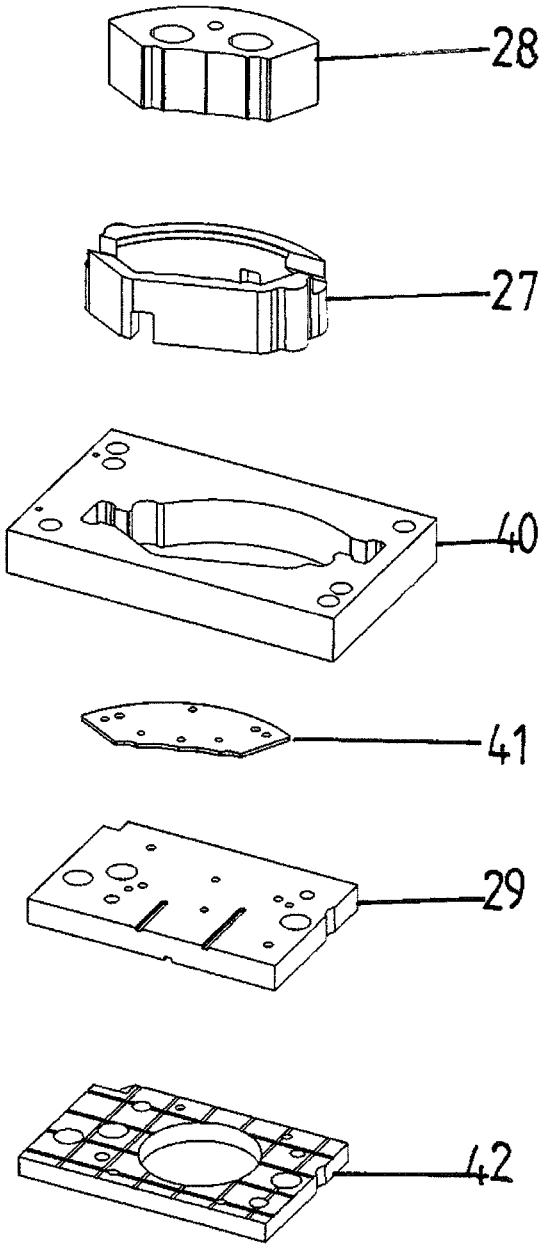
FIG. 7 shows a perspective view of the lower die part.

The lower die part 18 is shown in FIG. 7 in a depiction of revolution. The lower die part is composed of the embossing anvil 28, a holder 27 for the embossing anvil 28, an embossing positioning plate 40, a shim 41, the lower embossing pressure plate 29, and an intermediate plate 42.

Figure 8:
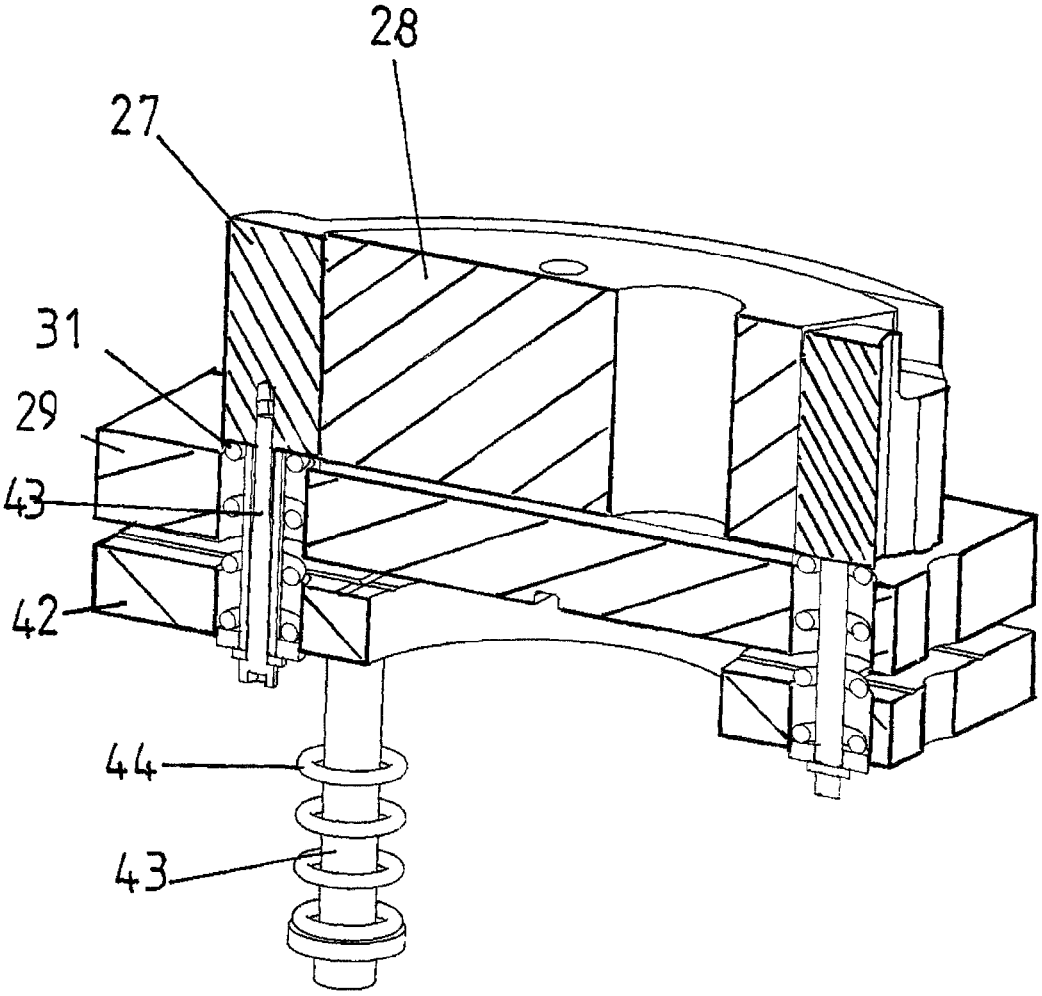
FIG. 8 shows a perspective view of the embossing anvil with the holder.

FIG. 8 shows a section of the lower die part 18. It is clearly apparent that the holder 27 is held on the intermediate plate 42 by way of the compression spring 31 in conjunction with the screw bolt 43, and the intermediate plate 42 is held in a spring-loaded manner on the lower block 15 of the forming stage 13 by way of a compression spring 44 and a pin 43 (see also FIG. 3*a*).

The sequence of the method according to the invention is shown based on FIGS. 9*a* to 9*e*.

Figure 9A:
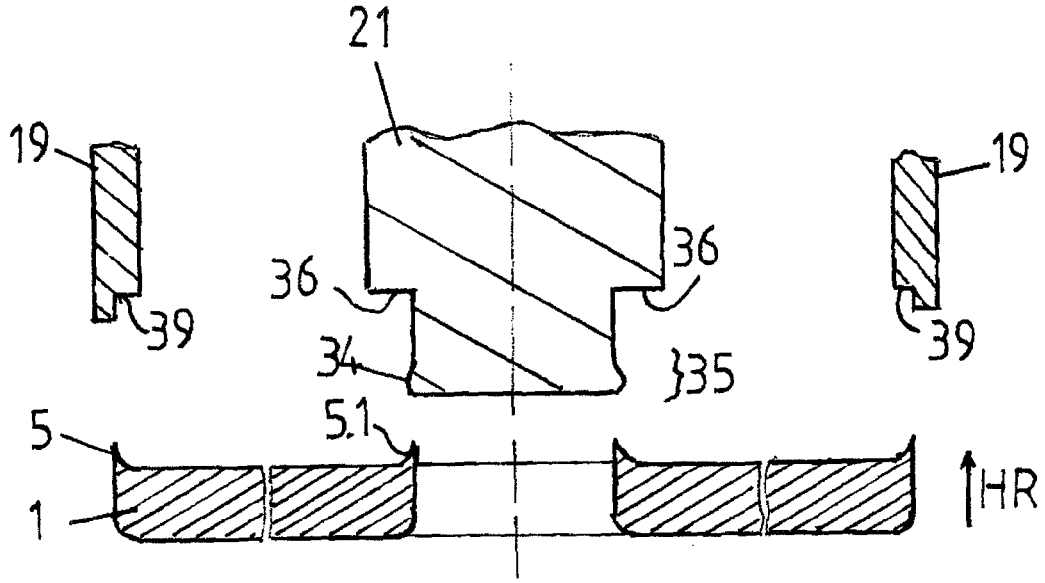
FIGS. 9*a* to 9*e* show schematic illustrations of the sequence of the method according to the invention with simultaneous mashing of the burrs on the outer and inner contours.

FIG. 9*a* is based on the open state of the device. The ejector 20 and the embossing anvil 28 are not shown in detail for the sake of simplicity. The shaping region 35 and the embossing shoulder 36 of the shaping punch 21, and the embossing shoulder 39 of the embossing bell 19 are located non-engaged above the workpiece 1.

Figure 9B:
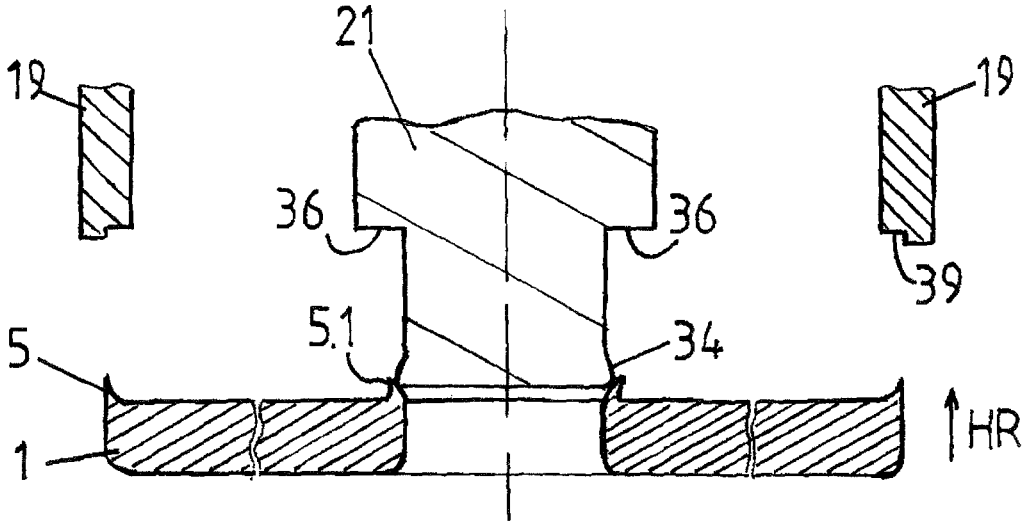
Figure 9C:
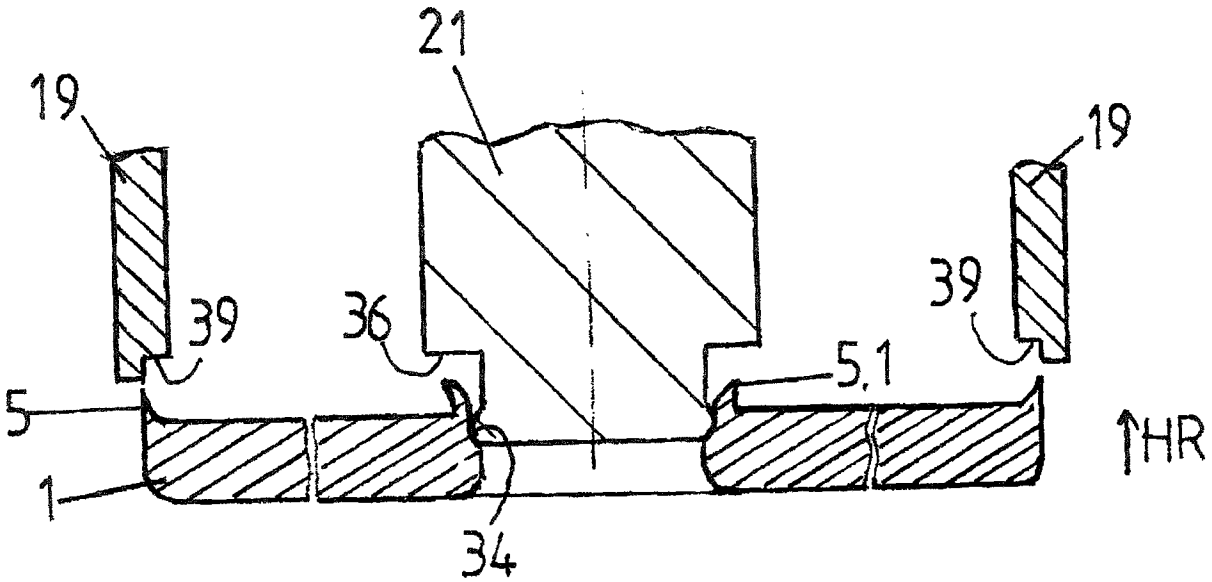

FIG. 9*b* shows the state in which the workpiece 1 has reached the burr 5.1 on the sheared edge 8 of the inner contour 7 during the stroke. The upwardly projecting burr 5.1 is bent slightly outward in the direction of the outer contour 2 with the burr embossing radius GR by the spherical segment-shaped thickening 34, so that the subsequent mashing of the burr 5.1 extends outwardly away from the inner contour 7.

After another stroke of the workpiece 1, the spherical segment-shaped thickening 34 of the shaping region 35 seizes the sheared edge 8 of the inner contour 7 and displaces material into the interior of the workpiece 1. This creates a defined widening of the inner contour 7 on the workplace 1. The defined widening is determined by the oversized dimension of the shaping region 35 in relation to the inner contour 7 or the hole 9 (see FIG. 9*c*). The widening of the inner contour is ended as soon as the sheared edge 8 no longer engages the shaping region 35, which is to say as soon as the shaping region 35 of the shaping punch 21 has moved through the inner contour 7.

Figure 9D:
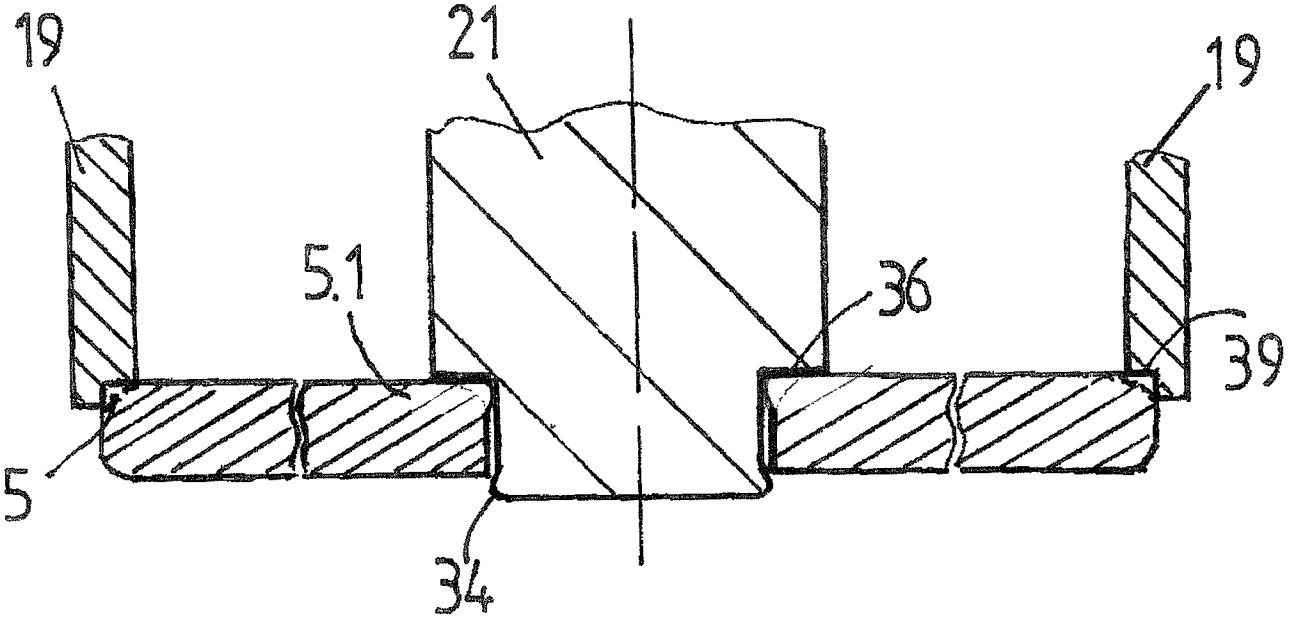

FIG. 9*d* shows that the embossing shoulder 36 of the shaping punch 21 has mashed the slightly bent burr 5.1 on the workpiece 1 away from the inner contour 7. The embossing shoulder 39 of the embossing bell 19 engages the burr 5 of the sheared edge 3 of the outer contour 2 simultaneously with the embossing shoulder 36 of the shaping punch 21, so that the burr 5 is mashed on the workpiece 1 in the direction of the inner contour 7.

If only one outer contour 2, such as a disk, is to be produced, the simultaneous mashing is dispensed with of course, without departing from the method according to the invention.

Figure 9E:
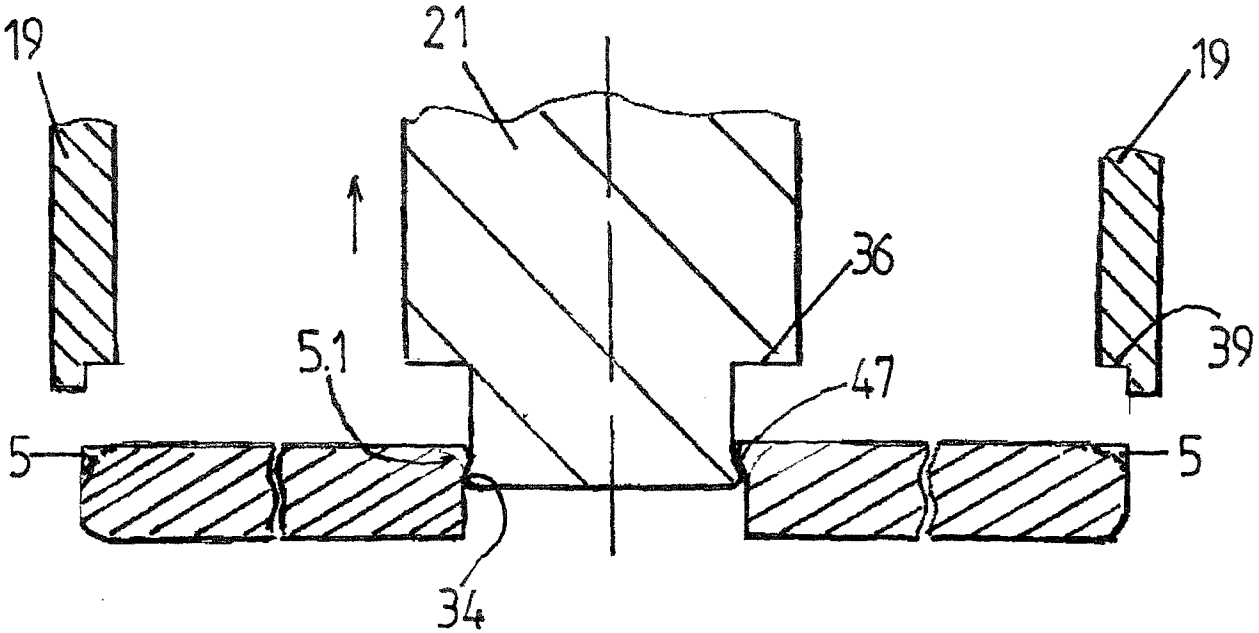

FIG. 9*e* shows the state in which the shaping punch 21 carries out a return stroke movement counter to the stroke direction HR so as to demold the shaping punch 21 from the workpiece 1. The shaping region 35 seizes the embossing bead 47 during the return stroke and flattens the same to the final dimensions.

The invention claimed is:

1. Apparatus for shaping sheared edges on stamped or fine-blanked work pieces having at least one burr, comprising an upper part and a lower part, which form at least one cutting stage comprising a stamping or fine-blanking stage for cutting at least one of outer or inner contours of the workpiece, and at least one forming stage for mashing the at least one burr created during cutting, the forming stage comprising a fixed upper die part having an embossing bell and a lower die part movable in a stroke direction and having an embossing anvil, wherein the forming stage comprises a shaping punch, which has a shaping region for smoothing sheared edges of the inner contour to a final shape and an embossing shoulder for mashing the burr of the inner contour, the shaping punch being configured so that the shaping region initially bends the at least one burr on the inner contour away from the respective sheared edge, then engages the sheared edges and, by material displacement, widens the inner contour along the circumference thereof, and so that the embossing shoulder of the shaping punch mashes the respective burr on the inner contour when the widening on the workpiece has ended and, during separating of the shaping punch from the workpiece, flattens an embossing bead created during the mashing.

2. The apparatus according to claim 1, wherein the shaping punch is configured for the inner contour of the workpiece.

3. The apparatus according to claim 1, wherein the shaping region of the shaping punch is formed of a spherical segment-shaped thickening that is provided at a head end thereof and is oversized in a defined manner in relation the inner contour for radially widening the sheared edge of said inner contour.

4. The apparatus according to claim 1, wherein the embossing shoulder is provided on the shaping punch at such a height from the head end of the shaping punch that, during vertical movement of the workpiece, the shaping region of the shaping punch first slightly bends the burr located on the inner contour away from the corresponding sheared edge and then engages the sheared edge to effect widening at the sheared edge inwardly of the inner contour by material displacement.

5. The apparatus according to claim 1, wherein the shaping punch is fixed on an upper block of the upper part in a stationary manner.

6. The apparatus according to claim 1, wherein the embossing bell is provided with an embossing shoulder and an ejector that is configured to be movable in the stroke direction is provided in the embossing bell to vertically guide the Shaping punch.

7. The apparatus according to claim 6, wherein the ejector is vertically guided by the embossing bell and is operatively connected to an upper hydraulic unit via pressure pins and an upper embossing pressure plate for moving the ejector with respect to the shaping punch.

8. The apparatus according to claim 6, wherein an upper hydraulic unit, which is operatively connected to the ejector via an upper embossing pressure plate, is accommodated in an upper block, and the shaping punch is attached in a fixed position on an upper embossing pressure plate.

9. The apparatus according to claim 6, wherein the ejector is operatively connected to an upper hydraulic unit via pressure pins that are subject to additional spring force for detaching the finished workpiece.

10. The apparatus according to claim 1, wherein the embossing anvil is vertically guided by a spring-loaded holder and is disposed on a lower embossing pressure plate which is operatively connected to a lower hydraulic unit for moving the embossing anvil in the stroke direction and back.

11. The apparatus according to claim 10, wherein the holder for the embossing anvil is vertically guided in an embossing positioning plate held by a cavity frame and has an annular surface which forms a seat for the embossing bell when the upper die part and the lower die part are closed.

12. The apparatus according to claim 11, wherein the cavity frame is fixed on a lower block in a stationary manner.

13. The apparatus according to claim 10, wherein the lower hydraulic unit is accommodated in a lower block and is operatively connected to the embossing anvil by lower pressure pins via a lower embossing pressure plate that is additionally supported by spring force.

14. The apparatus according to claim 1, wherein the embossing bell is configured for fixing the outer contour of the workpiece and has an annular configuration and completely surrounds the outer contour of the workpiece.

15. The apparatus according to claim 1, wherein the shaping region is circumferentially formed at an end of the shaping punch and has an outer circumference which is less than any other miter circumference of the shaping punch.

16. The apparatus according to claim 1, wherein the shaping region is circumferentially formed at an end of the shaping punch and comprises an annular protrusion extending circumferentially around the shaping region.

17. The apparatus according to claim 1, wherein the embossing bell comprises an embossing shoulder on an inside surface, the embossing shoulder being defined by an inner circumferential notch formed on an inner end of the embossing bell.

18. The apparatus according to claim 1, wherein the shaping region is formed circumferentially at an end of the shaping punch, and wherein the embossing bell comprises a circumferential notch on an inside surface of an end thereof.

19. The apparatus according to claim 17, wherein the shaping region and the circumferential notch are spaced from one another and face one another along a plane defined by the shaping region and the circumferential notch.

20. A method for shaping sheared edges of stamped or fine-blanked workpieces having a burr, using an apparatus according to claim 1, comprising cutting the outer and/or inner contours from a flat strip comprising the workpiece within the upper part and the lower part of the apparatus in the stamping or fine-blanking stage, transferring the cut workpiece into the forming stage after the stamping or fine blanking has been completed, and then shaping the workpiece the forming stage by the following steps in a single operation;

a) slightly bending the burr present on the sheared edge of the inner contour away from the sheared edge with the shaping punch having the shaping region, when the workpiece carries out a vertical movement in the stroke direction;

b) widening the sheared edge of the inner contour of the workpiece with the shaping region of the shaping punch to the intended final shape and dimensions until the embossing shoulder on the shaping punch engages the burr on the sheared edge of the inner contour;

c) creating an embossing bead in the sheared edge by mashing the burr of the inner contour of the workpiece with the embossing shoulder of the shaping punch; and d) flattening the embossing bead with the shaping region of the shaping punch during separating of the shaping punch from the workpiece by way of a vertical movement of the shaping punch counter to the stroke direction of the workpiece.

21. The method according to claim 20, wherein the widening according to step b) begins on the side of the sheared edge facing the burr and ends on the side of workpiece facing away from the burr.

22. The method according to claim 20, wherein shape and dimensions of the shaping punch are adapted to the inner contour of circular or non-circular openings the workpiece, with a dimension of the shaping punch being oversized by a predetermined amount.

23. The method according to claim 20, wherein the burr of the outer contour is mashed simultaneously with the burr of the inner contour by an embossing shoulder of the embossing bell, wherein the outer contour of the workpiece is fixed by the embossing bell, which is part of the upper die part, and the workpiece is deposited on the embossing anvil of the lower die part in an appropriately positioned manner.

* * * * *